US006148479A

United States Patent [19]

Lin

[11] Patent Number: 6,148,479

[45] Date of Patent: Nov. 21, 2000

[54] HINGE

[76] Inventor: John C. L. Lin, No. 146, Min-Chuan Road, Da-Hu Village, Hu-Ne Hsian, Kaohsiung Hsien, Taiwan

[21] Appl. No.: 09/339,170

[22] Filed: Jun. 24, 1999

[51] Int. Cl.[7] ..... E05D 7/10

[52] U.S. Cl. ..... 16/258; 16/257; 16/236

[58] Field of Search ..... 16/236, 238, 245, 16/246, 257, 258

[56] References Cited

U.S. PATENT DOCUMENTS

| | | | |
|---|---|---|---|
| 4,227,284 | 10/1980 | Zernig | 16/238 |
| 5,025,530 | 6/1991 | Ferrari et al. | 16/236 |
| 5,105,506 | 4/1992 | Lin | 16/258 |
| 5,276,944 | 1/1994 | Lin | 16/258 |
| 5,511,287 | 4/1996 | Lautenschläger et al. | 16/236 X |
| 5,937,479 | 8/1999 | Ohshima et al. | 16/257 |

FOREIGN PATENT DOCUMENTS 250868 6/1994 Taiwan .

*Primary Examiner*—Robert J. Sandy
*Attorney, Agent, or Firm*—Bacon & Thomas, PLLC

[57] ABSTRACT

A hinge mainly comprises a fixing plate, a base plate, a connection, and a door related hinge part. The fixing plate is provided with fixing holes for securing to the jamb of cabinet and a side plate having a auxiliary fixing hole. The base plate is mounted to the fixing plate and has two bumps and notches. The connection comprises a pin hooked by the notch of the base platen and a buckle being urged by a spring element to clasp the edge of the bump. The door related hinge part is mounted to the connection.

5 Claims, 3 Drawing Sheets

HINGE

BACKGROUND OF THE INVENTION

1. Field of the Invention

The present invention generally relates to a hinge, and more specifically, to a hinge for cabinet.

2. Description of the Related Art

Taiwan Utility Model Publication No. 250868 published on Jul. 1, 1995 discloses a disassembling hinge device for cabinet doors mainly including a base plate to be mounted on the jamb of cabinet, a connecting plate and a door related hinge part. The base plate has a protrusion which can be hooked by the leg of the connecting plate, and a engaging lip for engaging with an acting block. Pressing the handle of the acting block can control the engagement or disengagement between the base and the acting block. The door related hinge part is mounted on the connecting plate by means of the slots and the bolts. The door related hinge part has an pivotal end portion for mounting the door of the cabinet.

Conventional hinges as described above have the disadvantage that the door related hinge part can only be assembled on the base plate in a single direction, thereby making the mounting of the hinge inconvenient. Especially, when the base plate is mounted on the jamb of cabinet in a wrong direction, the door related hinge part can not be assembled on the base plate, at this time, the only way is unscrewing the base plate and re-mounting the base plate in a connect direction, thereby creating inconvenience of mounting.

Accordingly, the present invention is intended to provide a hinge which improves the drawbacks thereof and can be assembled by a more convenient process.

SUMMARY OF THE INVENTION

It is a primary object of the present invention to provide a hinge mainly comprising a fixing plate, a base plate, a connection, and a door related hinge part wherein the base plate is not necessary to be assembled with the door related hinge part in a specific direction.

The hinge in accordance with the invention mainly comprising a fixing plate to be mounted on the jamb of cabinet, a base plate, a connection, and a door related hinge part. The fixing plate has a positioning hole defined therein, two parallel long sides and a side plate extending from one of the long sides. The side plate has two sides perpendicular to the long sides of the fixing plate and an auxiliary fixing hole. The base plate mounted to the fixing plate which has a first channel being fitted tightly against the long sides of the fixing plate, a second channel is fitted tightly against the sides of the side plate, two bumps disposed over the second channel, and two notches disposed at both end thereof. The connection comprises a pin at one end thereof hooked by the notch of the base plate, a buckle pivotally connected to the other end thereof, and a spring element wherein the buckle has a hook portion being urged by the spring element to clasp the edge of the bump of the base plate. The door related hinge part is mounted to the connection.

The present invention overcomes the disadvantages of the conventional hinge. Firstly, the door related hinge part doesn't have to be mounted to the base plate in a specific direction. Secondly, even the base plate is mounted on the jamb of cabinet in a wrong direction, the door related hinge part can be disengaged from the base plate simply by pressing the buckle and then reassembled in a correct direction.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
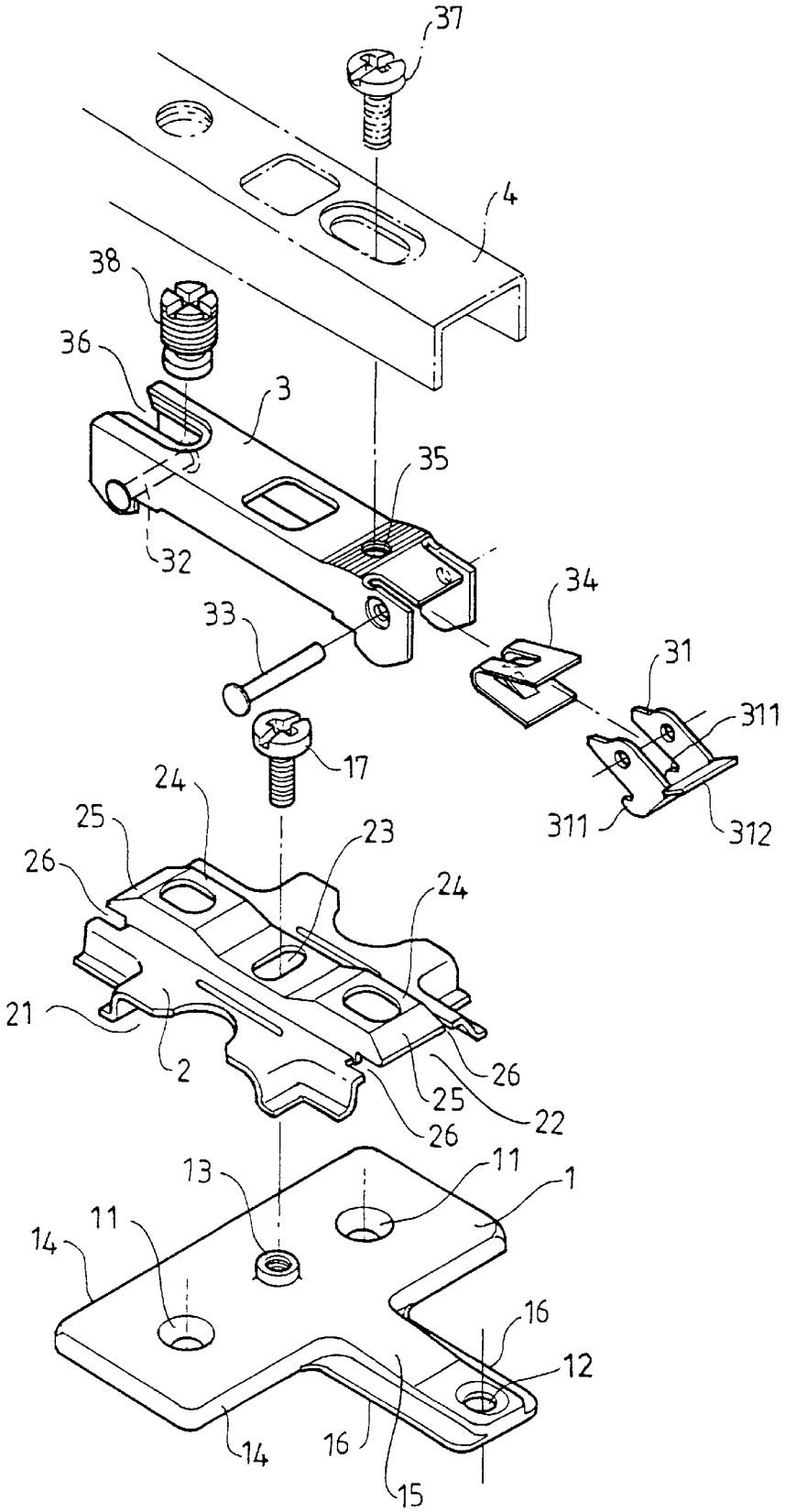
FIG. 1 is an exploded perspective view of an embodiment of the present invention.

FIG. 1 illustrates an embodiment in accordance with the present invention mainly comprising a fixing plate 1, a base plate 2, a connection 3 and a door related hinge part 4. The fixing plate 1 can be mounted on the jamb of cabinet by means of two fasteners such as bolts (not shown) and two fixing holes 11. The fixing plate 1 has two parallel long sides 14 and a side plate 15 extending from one of the long sides 14. The side plate 14 has two sides 16 perpendicular to the long sides 14 of the fixing plate 1 and an auxiliary fixing hole 12. The fixing plate 1 has a positioning hole 13 for receiving a fastener such as bolt 17 thereby joining with the base plate 2.

The base plate 2 having a central hole 23 for receiving a fastener such as bolt 17 thereby joining with the fixing plate 1. The central hole 23 can has a contour configured as different shapes designed as desired. The base plate 2 has a first channel 21 being fitted tightly against the long sides 14 of the fixing plate 1 and a second channel 22 is fitted tightly against the sides 16 of the side plate 15 wherein the first channel 21 is perpendicular to the second channel 22. Preferably, the central hole 23 of the base plate 2 is disposed at the cross position of the first channel 21 and the second channel 22 whereby the base plate 2 can be mounted to the fixing plate 1 in an interchangeable direction. The base plate 2 has two bumps 24 disposed over the second channel 22 wherein the central hole 23 is disposed between two bumps 24 and two notches 26 disposed at both end of the base plate 2. Preferably, each of the bumps 24 of the base plate 2 has a bevel 25.

The connection 3 is fitted tightly to two bumps of the base plate 2. The connection 3 comprises a pin 32 at one end thereof hooked by the notch 26 of the base plate 2, a buckle 31 pivotally connected to the other end thereof, and a spring element 34 wherein the buckle 31 has a hook portion 311 being urged by the spring element 34 to clasp the edge of the bump 24. Preferably, the buckle 31 has a handle 312 for the convenience of pressing.

The door related hinge part 4 can adopt any conventional structure. One end portion of the door related hinge part 4 is mounted to the connection 3 by fasteners such as bolts 37, 38 and the other end portion thereof is mounted on the door 52 of a cabinet.

Figure 2:
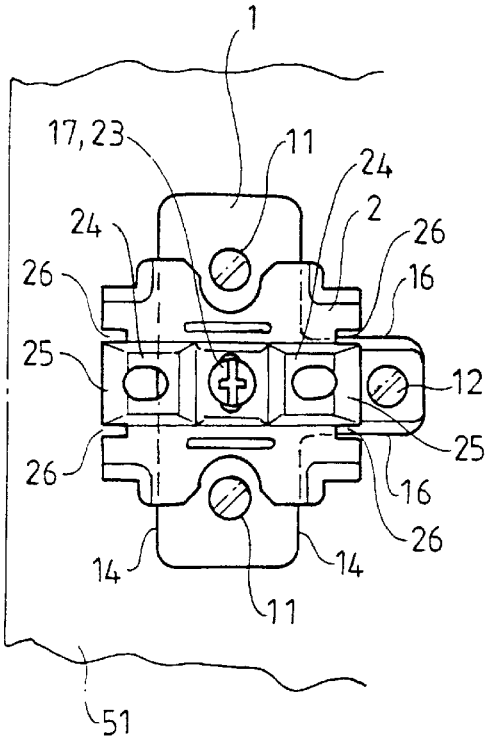
FIG. 2 is a top view of a base plate secured to a fixing plate in accordance with the present invention.

FIG. 2 illustrates the assembly of the fixing plate 1 and the base plate 2 in one direction. The fixing plate 1 is mounted on the jamb 51 of cabinet by means of fasteners such as bolts (not shown) and then the base plate 2 is secured to the fixing plate 1 by a fastener such as a bolt 17.

Figure 3:
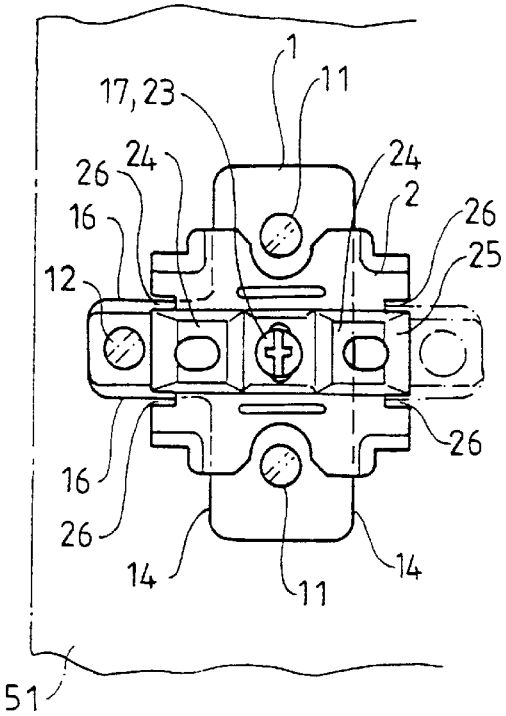
FIG. 3 is a top view of the base plate secured to the fixing plate in accordance with the present invention.

FIG. 3 illustrates the assembly of the fixing plate 1 and the base plate 2 in the other direction. As shown in FIG. 2 and FIG. 3, when the fixing plate 1 is mounted on the jamb 51 of cabinet in a wrong direction, it can be unscrewed and re-mounted on the jamb 51 of cabinet in a right direction. Because the auxiliary fixing hole 12 of the side plate 15 is changed to a new position, the fastener in the fixing hole 12 can provide better fixing effect.

Figure 4:
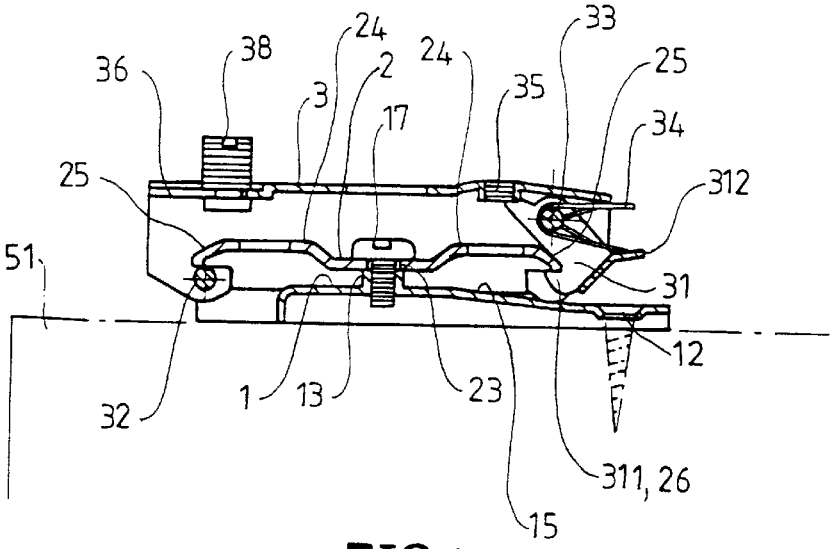
FIG. 4 is a cross sectional view of assembly of the fixing plate, the base plate, and a connection of the embodiment in accordance with the present invention.

FIG. 4 illustrates the assembly of the fixing plate 1, the base plate 2, and the connection 3 of the embodiment in accordance with the present invention. The pin 32 of the connection 3 can be hooked by the notch 26 of the base plate 2 and the hook portion 311 of the buckle 31 can be urged by the spring element 34 to clasp the edge the bevel 25 of the bump 24 whereby the connection 3 can be mounted to the base plate 2. Accordingly, the connection 3 as well as the base plate 2 and the fixing plate 1 can be mounted together. However, the connection 3 can be easily disengaged from the base plate 2 by pressing the buckle 31.

Figure 5:
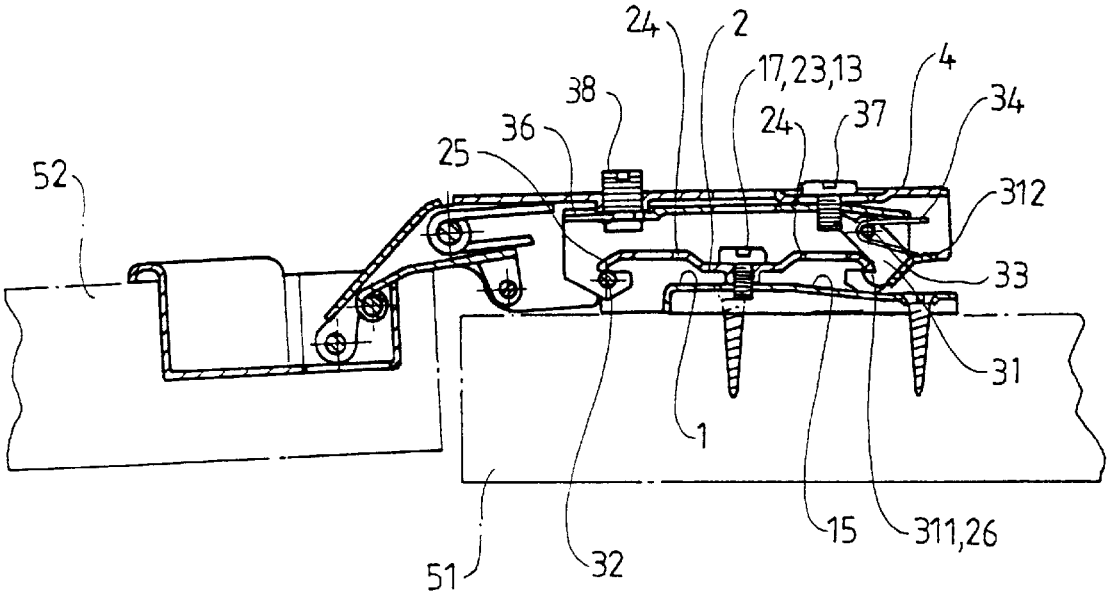
FIG. 5 is a cross sectional view of the embodiment in accordance with the present invention.

FIG. 5 illustrates the embodiment in accordance with the present invention. The door related hinge part 4 can be first mounted to the connection 3 in advance and together mounted to the base plate 2, and then the other end portion thereof can be mounted on the door 52 of a cabinet whereby the door 52 can be pivotally mounted to the jamb 51.

The effectiveness of the present invention is that the door related hinge part 3 doesn't have to be mounted to the base plate 2 in a specific direction. Even the base plate 1 is mounted on the jamb of cabinet in a wrong direction, the door related hinge part 4 can be disengaged from the base plate 2 simply by pressing the buckle 31 and then reassembled in a correct direction. Further, the fixing plate 1 is provided with the auxiliary fixing hole 12 such that the fixing plate 1 and the base plate 2 can be mounted to the jamb of cabinet more securely by fastener. Especially, when the fixing plate 1 is mounted in a wrong direction, it can be unscrewed and re-mounted in a right direction. Because the auxiliary fixing hole 12 is changed to a brand-new position, the fastener in the fixing hole 12 can provide better fixing effect.

Although the invention has been explained in relation to its preferred embodiments, it is to be understood that many other possible modifications and variations can be made without departing from the spirit and scope of the invention as hereinafter claimed.

What is claimed is:

1. A hinge comprising:

a fixing plate having at least two fixing holes and a positioning hole defined therein, said fixing plate having two parallel long sides and a side plate extending from one of the long sides, the side plate of said fixing plate having two sides perpendicular to the long sides of said fixing plate and an auxiliary fixing hole;

a base plate having a central hole for receiving a fastener thereby joining with said fixing plate, said base plate having a first channel and a second channel perpendicular to each other, the first channel is fitted tightly against the long sides of said fixing plate and the second channel is fitted tightly against the sides of the side plate of said fixing plate, said base plate having two bumps disposed over the second channel wherein the central hole is disposed therebetween, said base plate having two notches disposed at both ends thereof;

a connection comprising a pin at one end thereof hooked by one of the notches of said base plate a buckle pivotally connected to another end thereof, and a spring element wherein the buckle has a hook portion being urged by the spring element to clasp an edge of one of the bumps of said base plate; and a door related hinge part mounted to said connection.

2. The hinge as claimed in claim 1, wherein the central hole of said base plate is disposed at a cross position of the first channel and the second channel of said base plate.

3. The hinge as claimed in claim 1, wherein each of the bumps of said base plate has a bevel.

4. The hinge as claimed in claim 1 or 3, wherein the distance from each of the bumps of said base plate to the central hole of said base plate is the same.

5. The hinge as claimed in claim 1, wherein said buckle has a handle for the convenience of pressing.

* * * * *